US011660637B2

(12) United States Patent
Cheng et al.

(10) Patent No.: US 11,660,637 B2
(45) Date of Patent: May 30, 2023

(54) DRIVING DEVICE

(71) Applicant: I-SHOU UNIVERSITY, Kaohsiung (TW)

(72) Inventors: Chun-An Cheng, Kaohsiung (TW); Hung-Liang Cheng, Kaohsiung (TW); Ya-Jing Chen, Kaohsiung (TW)

(73) Assignee: I-SHOU UNIVERSITY, Kaohsiung (TW)

( * ) Notice: Subject to any disclaimer, the term of this patent is extended or adjusted under 35 U.S.C. 154(b) by 297 days.

(21) Appl. No.: 16/917,873

(22) Filed: Jun. 30, 2020

(65) Prior Publication Data

US 2021/0276043 A1 Sep. 9, 2021

(30) Foreign Application Priority Data

Mar. 5, 2020 (TW) ..... 109107184

(51) Int. Cl.
*B06B 1/02* (2006.01)

(52) U.S. Cl.
CPC ..... *B06B 1/0223* (2013.01)

(58) Field of Classification Search
CPC ..... B06B 1/0223; B06B 2201/71
USPC ..... 318/114
See application file for complete search history.

(56) References Cited

U.S. PATENT DOCUMENTS

| | | | | |
|---|---|---|---|---|
| 6,194,840 | B1 | 2/2001 | Chang | |
| 9,554,871 | B2 | 1/2017 | Kovnatsky et al. | |
| 2015/0303813 | A1* | 10/2015 | Cheng | H02M 1/4258 363/21.02 |

FOREIGN PATENT DOCUMENTS

| | | |
|---|---|---|
| CN | 1960149 | 5/2007 |
| CN | 103875314 | 6/2014 |
| CN | 208537941 | 2/2019 |
| TW | 201201494 | 1/2012 |
| TW | I426245 | 2/2014 |

OTHER PUBLICATIONS

Hung-Liang Cheng, et al., "Single-Switch High-Power-Factor Inverter Driving Piezoelectric Ceramic Transducer for Ultrasonic Cleaner," IEEE Transactions on Industrial Electronics, vol. 58, No. 7, Jul. 2011, pp. 2898-2905.

Jirapong Jittakort, et al., "Full bridge resonant inverter using asymmetrical control with resonant-frequency tracking for ultrasonic cleaning applications," Journal of power electronics, vol. 17, No. 5, Sep. 2017, pp. 1150-1159.

Yu-Kai Chen, et al., "Design and Implementation of Piezoelectric Transducer Driving System with MPPT and ZVS Features," Asian Journal of Engineering and Technology, vol. 2, Issue 5, Oct. 2014, pp. 460-465.

(Continued)

*Primary Examiner* — Daniel L Murphy
(74) *Attorney, Agent, or Firm* — JCIPRNET

(57) ABSTRACT

A driving device is provided. The driving device includes a boost inductor and a resonance circuit. The boost inductor receives a first power via a first terminal of the boost inductor in a first mode and provides a second power via a second terminal of the boost inductor. The resonance circuit stores a stored electric energy from the second power in the first mode, so that the boost inductor does not provide the second power in the second mode and drives a transducer by the stored electric energy in the first mode and the second mode.

10 Claims, 8 Drawing Sheets

(56) References Cited

OTHER PUBLICATIONS

Jirapong Jittakort, et al., "LCCL series resonant inverter for ultrasonic dispersion system with resonant frequency tracking and asymmetrical voltage cancellation control," IECON 2015—41st Annual Conference of the IEEE Industrial Electronics Society, Nov. 9-12, 2015, pp. 2491-2496.

Chan Ihsuan, "Design and Implementation of Ultrasonic Power Drivers," Thesis of Master Degree, National United University, Jan. 2013, pp. 1-98, abstract only in English.

Negareh Ghasemi, et al., "Power electronic converters for high power ultrasound transducers," 2012 7th IEEE Conference on Industrial Electronics and Applications (ICIEA), Jul. 18-20, 2012, pp. 647-652.

L. F. Brown, et al., "Design considerations for piezoelectric polymer ultrasound transducers," IEEE Transactions on Ultrasonics, Ferroelectrics, and Frequency Control, vol. 47, No. 6, Nov. 2000, pp. 1377-1396.

Whirl Best International Co., Ltd., "WB-series Oscillator," pp. 1-6, Available at: http://www.whbest168.com/media/attachments/2018/06/21/oscillator_catalog.pdf.

Fu-Sheng Pai, et al., "Design and Realization of Piezoelectric Ceramic Resonant System," 2010 the 31th Symposium on Electrical Power Engineering, Tainan, Taiwan, Dec. 3-4, 2010, pp. 2160-2164, abstract only in English.

Jun-An Lai, "Two-Stage Driver Design for Piezoelectric Actuator," Thesis of Master Degree, Chung Yuan Christian University, Jul. 2004, pp. 1-114, abstract only in English.

* cited by examiner

DRIVING DEVICE

CROSS-REFERENCE TO RELATED APPLICATION

This application claims the priority benefit of Taiwan patent application serial no. 109107184, filed on Mar. 5, 2020. The entirety of the above-mentioned patent application is hereby incorporated by reference and made a part of this specification.

BACKGROUND OF THE INVENTION

1. Field of the Invention

The invention relates to a driving device, and in particular, to a driving device configured to drive a transducer.

2. Description of Related Art

Ultrasonic waves are wave vibrations that exceed several times and even hundreds of times of human hearing, and ultrasonic cleaners use ultra high-frequency vibrations to clean objects. The ultrasonic cleaners use ultrasonic waves to pass through liquid and remove dirt and dust on material surfaces, holes, and gaps, and are widely used for cleaning glasses, contacts, jewels, watches, false teeth, electronic devices, and the like.

An ultrasonic cleaner generally uses a transducer (for example, a piezoelectric ceramic transducer) as a vibration source of the ultrasonic cleaner, and the transducer generates mechanical vibrations by applying an excitation signal of more than a frequency 20 kHz to the transducer. The transducer uses the piezoelectric effect to generate mechanical vibrations, and when an alternating current power is applied to the transducer, the transducer has mechanical waves in positive and negative directions.

Because the transducer is operated at a high frequency, a drive circuit configured to drive the transducer generates a switching loss in the high-frequency operation. Therefore, as can be seen, how to reduce the switching loss of the drive circuit in the high-frequency operation is one of the development emphases of the high-frequency drive circuit.

SUMMARY OF THE INVENTION

The invention provides a driving device having a low switching loss in a high-frequency operation.

The driving device of the invention is adapted to drive a transducer. The driving device includes a boost inductor, a rectifying circuit, and a resonance circuit. The boost inductor is configured to receive a first power via a first terminal of the boost inductor in a first mode, and provide a second power via a second terminal of the boost inductor. The rectifying circuit is coupled to the second terminal of the boost inductor. The rectifying circuit is configured to limit a transmission path of the second power. The resonance circuit is coupled to the transducer and the rectifying circuit. The resonance circuit is configured to store a stored electric energy from the second power in the first mode, so that the boost inductor does not provide the second power in the second mode, and drive the transducer by the stored electric energy in the first mode and the second mode. The first mode and the second mode are alternately operated.

Based on the above, the driving device stores the stored electric energy from the second power by the resonance circuit in the first mode, so that the boost inductor does not provide the second power in the second mode, and drives the transducer by the stored electric energy in the first mode and the second mode. Therefore, the boost inductor is operated in equivalence in a discontinuous conduction mode, so that the driving device has an effect of correcting power factors. In addition, zero voltage switching (ZVS) occurs when the driving device switches from the first mode to the second mode, thereby reducing a switching loss.

To make the features and advantages of the invention clear and easy to understand, the following gives a detailed description of embodiments with reference to accompanying drawings.

DESCRIPTION OF THE EMBODIMENTS

Figure 1:
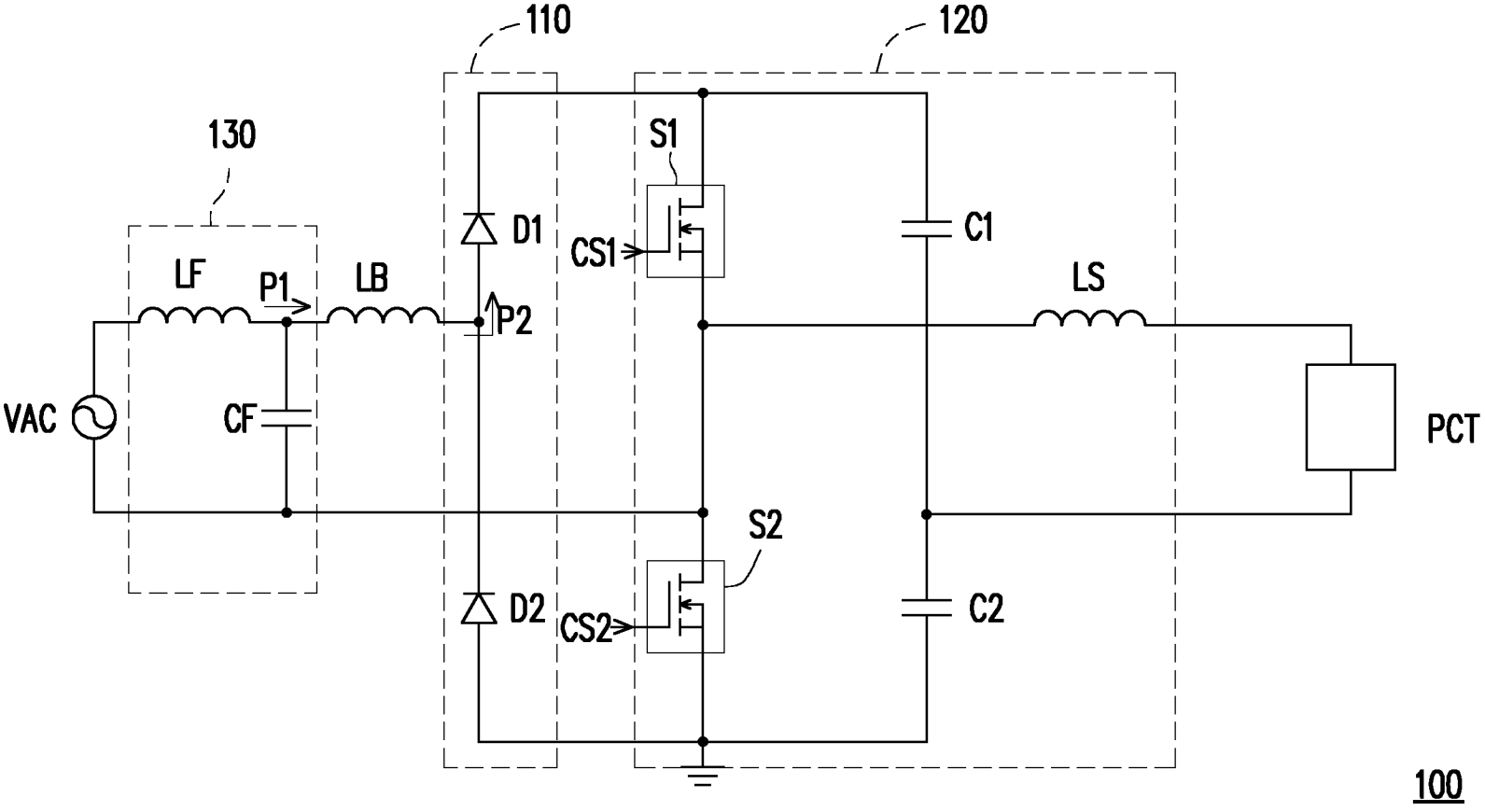
FIG. 1 is a schematic circuit diagram of a driving device shown according to an embodiment of the invention.

FIG. 1 is a schematic circuit diagram of a driving device shown according to an embodiment of the invention. In the present embodiment, the driving device 100 is configured to drive a transducer PCT. The transducer PCT is, for example, a piezoelectric ceramic transducer. The driving device 100 includes a boost inductor LB, a rectifying circuit 110, and a resonance circuit 120. The driving device 100 is operated in a first mode and a second mode. The first mode and the second mode are alternately operated. In the present embodiment, the boost inductor LB receives a first power P1 via a first terminal of the boost inductor LB in the first mode, and provides a second power P2 via a second terminal of the boost inductor LB. The rectifying circuit 110 is coupled to the second terminal of the boost inductor LB. The rectifying circuit 110 is configured to limit a transmission path of the second power P2.

In the present embodiment, the resonance circuit 120 is coupled to the transducer PCT and the rectifying circuit 110. The resonance circuit 120 stores a stored electric energy from the second power P2 in the first mode, and makes the boost inductor LB not provide the second power P2 in the second mode. In addition, the resonance circuit 120 drives the transducer PCT by the stored electric energy in the first mode and the second mode.

It is worth mentioning herein that, because the driving device 100 makes the boost inductor LB not provide the second power P2 in the second mode, the boost inductor LB is operated in equivalence in a discontinuous conduction mode, so that the driving device 100 has an effect of correcting power factors. In addition, zero voltage switching (ZVS) occurs when the driving device 100 switches from the first mode to the second mode, thereby reducing a switching loss.

In the present embodiment, the driving device 100 further includes a filter 130. The filter 130 receives an external power VAC, and filters out noise of the external power VAC to provide the first power P1. Further, the external power VAC is an alternating current power. The filter 130 filters out high-frequency noise of the external power VAC to provide the first power P1. That is, based on the configuration of FIG. 1, the first power P1 may be regarded as the external power VAC obtained after the high-frequency noise is filtered out.

The circuit configuration is further described in detail. The resonance circuit 120 includes a first power switch S1, a second power switch S2, a series inductor LS, a first capacitor C1, and a second capacitor C2. A first terminal of the first power switch S1 is coupled to a second terminal of the boost inductor LB via the rectifying circuit 110. A control terminal of the first power switch S1 is configured to receive a first control signal CS1. A first terminal of the second power switch S2 is coupled to a second terminal of the first power switch S1. A second terminal of the second power switch S2 is coupled to a reference low potential (for example, is grounded). A control terminal of the second power switch S2 is configured to receive a second control signal CS2. According to design requirements, the first control signal CS1 and the second control signal CS2 may be generated from a control signal generator (not shown). A first terminal of the series inductor LS is coupled to the second terminal of the first power switch S1. A second terminal of the series inductor LS is coupled to one of power electrodes of the transducer PCT. A first terminal of the first capacitor C1 is coupled to the first terminal of the first power switch S1. A second terminal of the first capacitor C1 is coupled to the other one of the power electrodes of the transducer PCT. A first terminal of the second capacitor C2 is coupled to the second terminal of the first capacitor C1. A second terminal of the second capacitor C2 is coupled to the reference low potential.

The first power switch S1 and the second power switch S2 may be respectively implemented by one of a metal-oxide-semiconductor field-effect transistor (MOSFET), a bipolar transistor (BJT), and an insulated gate bipolar transistor (IGBT). The first power switch S1 and the second power switch S2 of the present embodiment are respectively implemented by an n-type MOSFET. Therefore, the first power switch S1 may be conducted according to the first control signal CS1 at a high voltage level. The first power switch S1 may be disconnected according to the first control signal CS1 at a low voltage level. The second power switch S2 may be conducted according to the second control signal CS2 at a high voltage level. The second power switch S2 may be disconnected according to the second control signal CS2 at a low voltage level.

In the present embodiment, the rectifying circuit 110 includes a first diode D1 and a second diode D2. A cathode of the first diode D1 is coupled to the first terminal of the first power switch S1. An anode of the first diode D1 is coupled to the second terminal of the boost inductor LB. A cathode of the second diode D2 is coupled to the anode of the first diode D1. An anode of the second diode D2 is coupled to the reference low potential.

In the present embodiment, the filter 130 includes a filter inductor LF and a filter capacitor CF. A first terminal of the filter inductor LF is used as one of power pins connected to the external power VAC, and a second terminal of the filter inductor LF is coupled to the first terminal of the boost inductor LB. A first terminal of the filter capacitor CF is coupled to the first terminal of the boost inductor LB and the second terminal of the filter inductor LF. A second terminal of the filter capacitor CF is used as the other one of the power pins connected to the external power VAC. The second terminal of the filter capacitor CF is further coupled to the second terminal of the first power switch S1. Therefore, the first terminal of the filter inductor LF and the second terminal of the filter capacitor CF are used as two input terminals of the filter 130. The second terminal of the filter inductor LF is used as an output terminal of the filter 130.

It is worth mentioning herein that, the resonance circuit 120 of the present embodiment includes a first power switch S1 and a second power switch S2. Therefore, compared with four power switches in the prior art, the present embodiment has an advantage of reducing the quantity of power switches.

Figure 2:
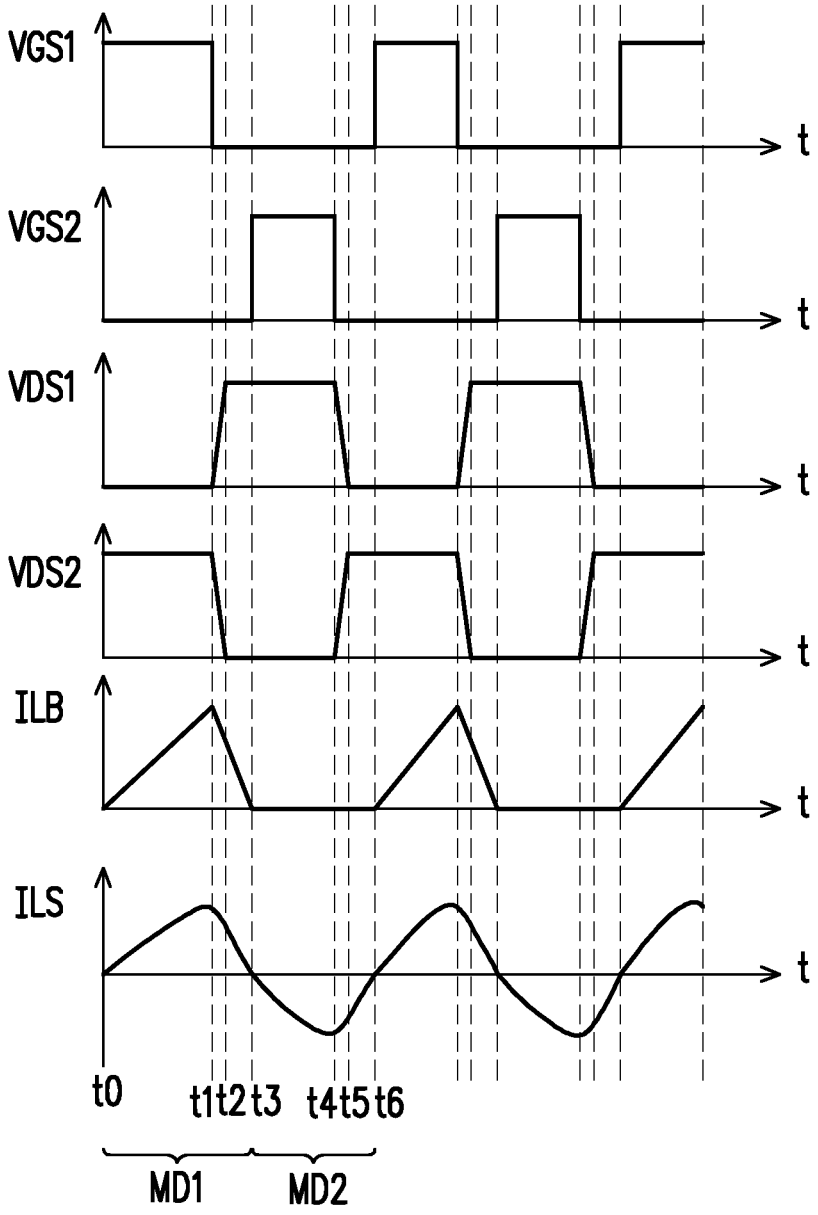
FIG. 2 is an operation sequence diagram shown according to an embodiment of the invention
Figure 3A:
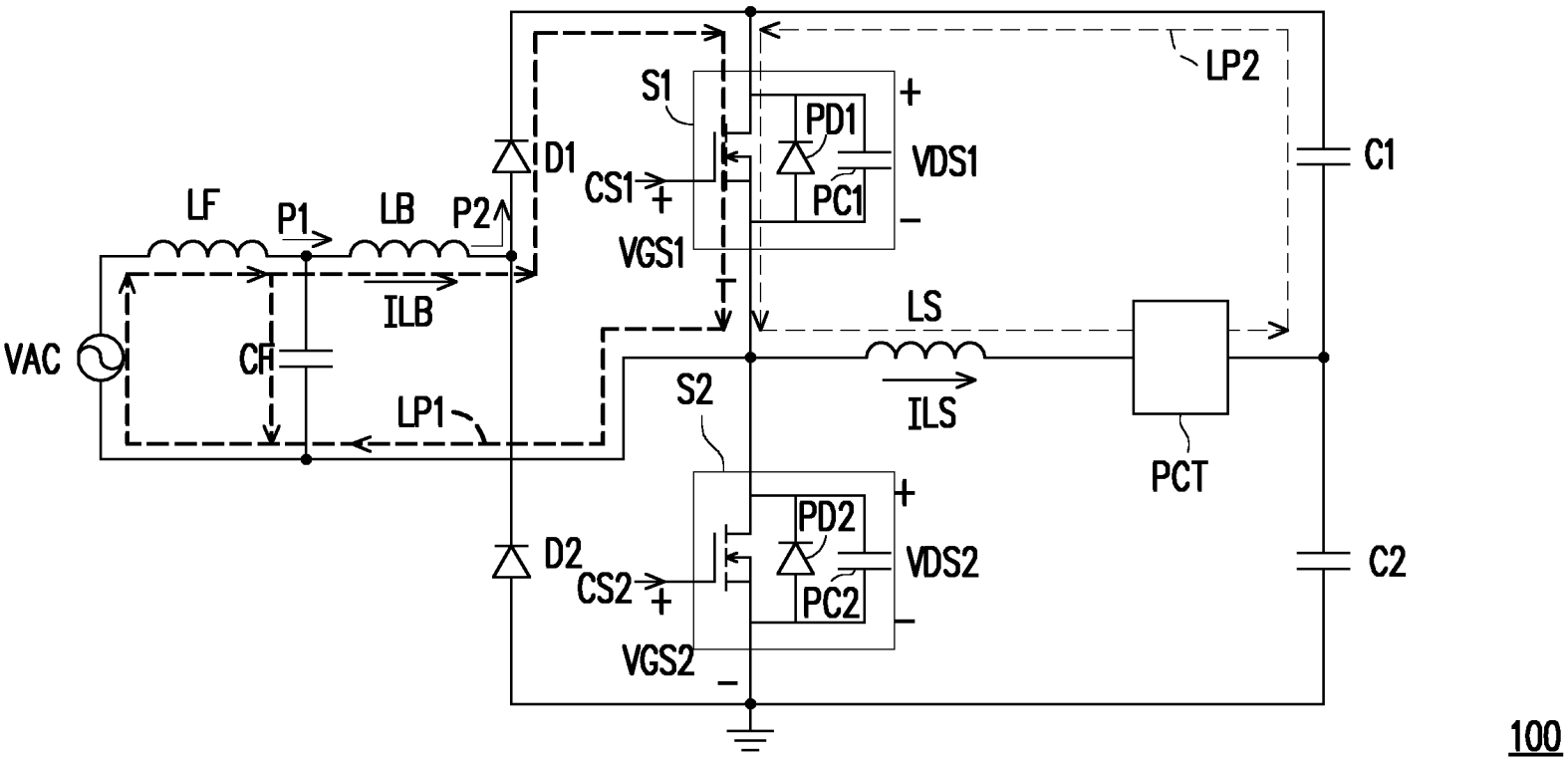
FIG. 3A to FIG. 3F are respectively schematic diagrams of equivalent circuits of a plurality of modes of the driving device according to an embodiment of the invention.

The operation process of the driving device is described next. Referring to FIG. 2 and FIG. 3A together, FIG. 2 is an operation sequence diagram shown according to an embodiment of the invention. FIG. 3A to FIG. 3F are respectively schematic diagrams of equivalent circuits of a plurality of modes of the driving device according to an embodiment of the invention.

As shown in FIG. 2 and FIG. 3A, at a time point t0, the first power switch S1 is conducted according to the first control signal CS1 at the high voltage level. A voltage difference VGS1 between a control terminal (gate) and a second terminal (source) of the first power switch S1 is a high voltage level. A voltage difference VDS1 between a first terminal (drain) and the second terminal (source) of the first power switch S1 is a low voltage level. The second power switch S2 is disconnected according to the second control signal CS2 at the low voltage level. A voltage difference VGS2 between a control terminal (gate) and a second terminal (source) of the second power switch S2 is a low voltage level. A voltage difference VDS2 between a first terminal (drain) and the second terminal (source) of the second power switch S2 is a high voltage level. The driving device 100 starts to be operated in the first mode MD1 at the time point t0. The filter circuit 130 receives the external power VAC, and filters out noise of the external power VAC to provide the first power P1.

At the time point t0, the filter circuit 130, the boost inductor LB, the diode D1, and the conducted first power switch S1 form an energy loop LP1. Therefore, the boost inductor LB receives the first power P1 via the energy loop LP1 and provides the second power P2. In a first time interval (a time interval between the time point t0 and a time point t1) of the first mode MD1, a boost inductor current value ILB of the boost inductor LB rises. In the first time interval of the first mode MD1, the first capacitor C1, the conducted first power switch S1, the series inductor LS, and the transducer PCT form an energy loop LP2. The electric energy stored in the first capacitor C1 is provided to the series inductor LS and the transducer PCT via the energy loop LP2. When the boost inductor current value ILB rises to a maximum value at the time point t1, the first power switch S1 is disconnected according to the first control signal CS1 at the low voltage level.

Figure 3B:
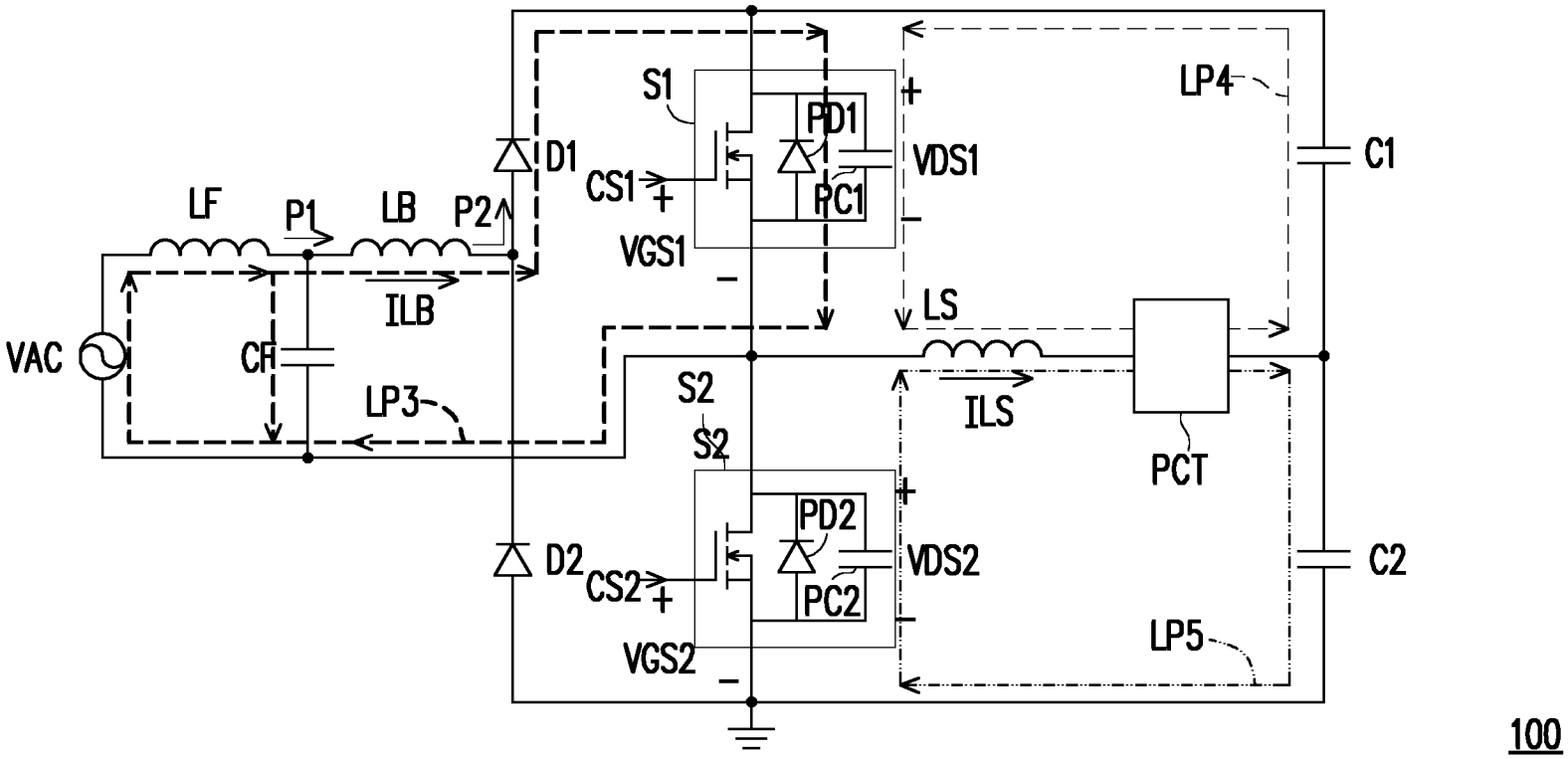

As shown in FIG. 2 and FIG. 3B, at the time point t1, the first power switch S1 is disconnected. Therefore, the filter circuit 130, the boost inductor LB, the diode D1, and a parasitic capacitor PC1 of the first power switch S1 form an energy loop LP3. Therefore, the parasitic capacitor PC1 of the first power switch S1 stores the electric energy of the second power P2. In this case, the boost inductor current value ILB starts to drop. In a second time interval (a time interval between the time point t1 and a time point t2) of the first mode MD1, the first capacitor C1, the parasitic capacitor PC1 of the first power switch S1, the series inductor LS, and the transducer PCT form an energy loop LP4. The electric energy stored in the first capacitor C1 and the series inductor LS is provided to the parasitic capacitor PC1 of the first power switch S1 and the transducer PCT via the energy loop LP4. Therefore, the voltage difference VDS1 between the first terminal (drain) and the second terminal (source) of the first power switch S1 gradually rises. In the second time interval (the time interval between the time point t1 and the time point t2) of the first mode MD1, a parasitic capacitor PC2 of the second power switch S2, the series inductor LS, the transducer PCT, and the second capacitor C2 form an energy loop LP5. The electric energy stored in the series inductor LS and the second capacitor C2 is also provided to the parasitic capacitor PC2 of the second power switch S2 and the transducer PCT via the energy loop LP5. Therefore, the voltage difference VDS2 between the first terminal (drain) and the second terminal (source) of the second power switch S2 gradually drops.

Figure 3C:
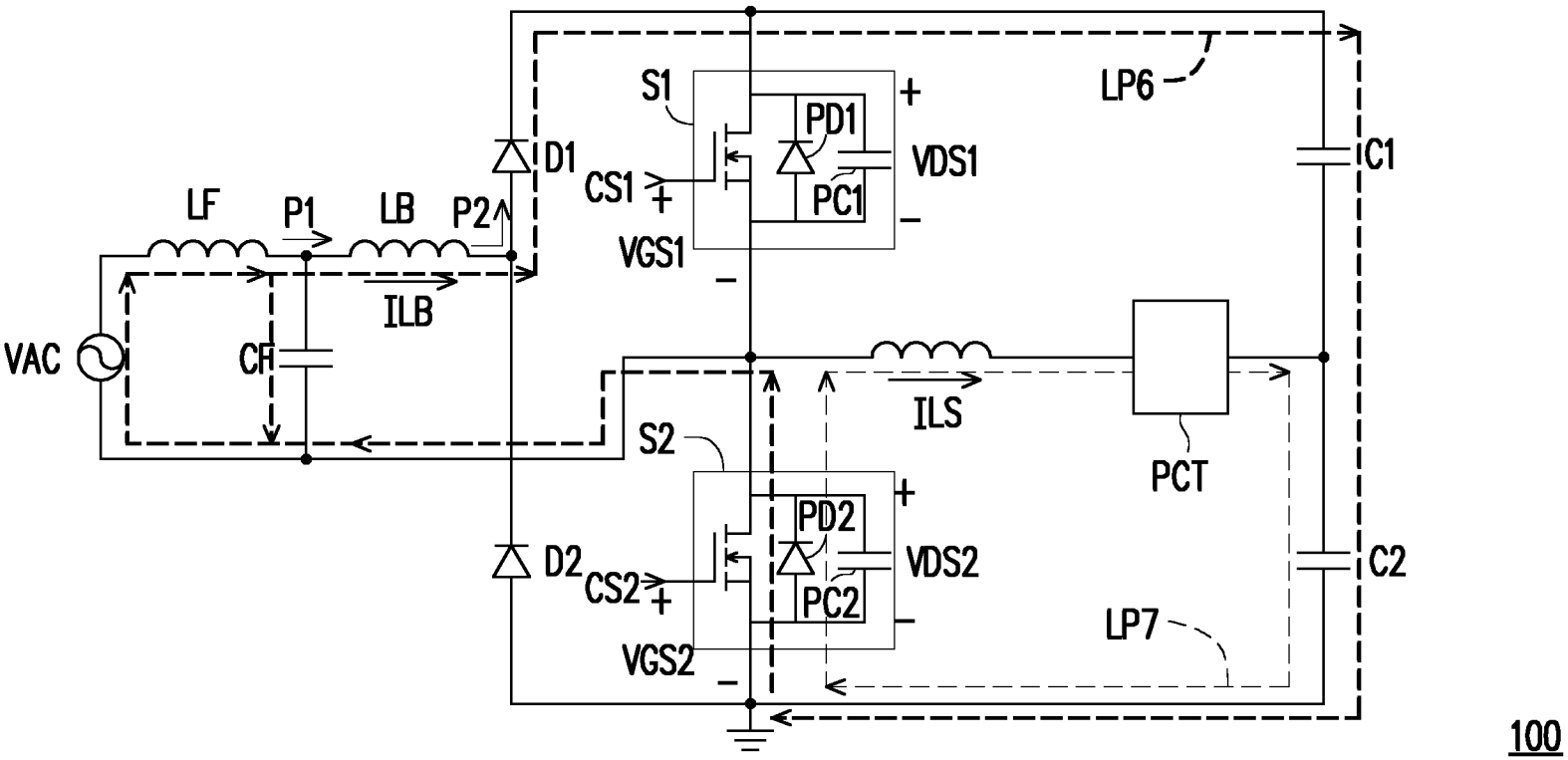

As shown in FIG. 2 and FIG. 3C, at the time point t2, when the electric energy of the parasitic capacitor PC2 of the power switch S2 is released completely at the time point t2, the voltage difference VDS2 between the first terminal (drain) and the second terminal (source) of the second power switch S2 drops to 0 V. An intrinsic diode PD2 of the second power switch S2 is conducted. In a third time interval (a time interval between the time point t2 and a time point t3) of the first mode MD1, the filter 130, the boost inductor LB, the first diode D1, the first capacitor C1, the second capacitor C2, and the intrinsic diode PD2 of the second power switch S2 form an energy loop LP6. The electric energy of the second power P2 is provided to the first capacitor C1 and the second capacitor C2 via the energy loop LP6. The boost inductor current value ILB continuously drops. The series inductor LS, the transducer PCT, the second capacitor C2, and the intrinsic diode PD2 of the second power switch S2 form an energy loop LP7. The electric energy stored in the series inductor LS is provided to the transducer PCT via the energy loop LP7. The boost inductor current value ILB drops to 0 A at the time point t3.

Figure 3D:
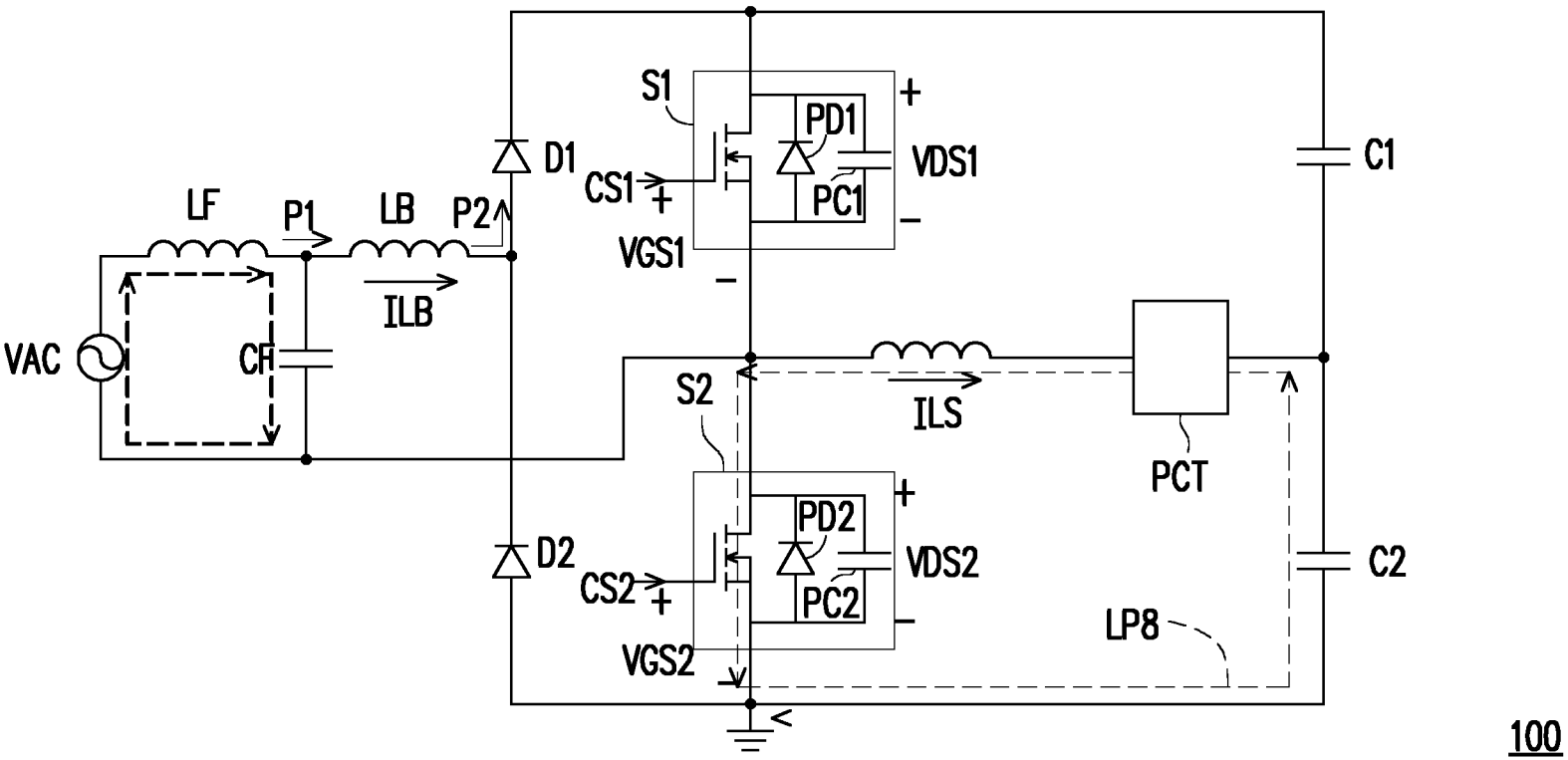

As shown in FIG. 2 and FIG. 3D, at the time point t3, when the boost inductor current value ILB drops to 0 A, the driving device 100 conducts the second power switch S2 according to the second control signal CS2, and switches from the first mode MD1 to the second mode MD2. The voltage difference VGS2 between the control terminal (gate) and the second terminal (source) of the second power switch S2 is a high voltage level. The voltage difference VDS2 between the first terminal (drain) and the second terminal (source) of the second power switch S2 keeps at the low voltage level. In this case, because the boost inductor current value ILB is 0 A, the boost inductor LB is a non-conducted state in equivalence. Therefore, the boost inductor LB starts not to provide the second power P2 at the time point t3, and the driving device 100 performs ZVS at the time point t3 to reduce a switching loss of switching from the first mode MD1 to the second mode MD2. In a fourth time interval (a time interval between the time point t3 and a time point t4) of the second mode MD2, the second capacitor C2, the transducer PCT, the series inductor LS and the conducted second power switch S2 form an energy loop LP8. The electric energy stored in the second capacitor C2 is provided to the transducer PCT and the series inductor LS via the energy loop LP8.

Incidentally, according to the dropping speed of the boost inductor current value ILB, the time point t3 may be close to the time point t2.

It should be noted herein that, in the first mode MD1, a series inductor current value ILS of the series inductor LS is greater than 0. In the second mode MD2, the series inductor current value ILS of the series inductor LS is less than 0. That is, a current direction in which the electric energy stored in the resonance circuit 120 flows through the transducer PCT in the first mode MD1 is opposite to a current direction in which the electric energy flows through the transducer PCT in the second mode MD2.

Figure 3E:
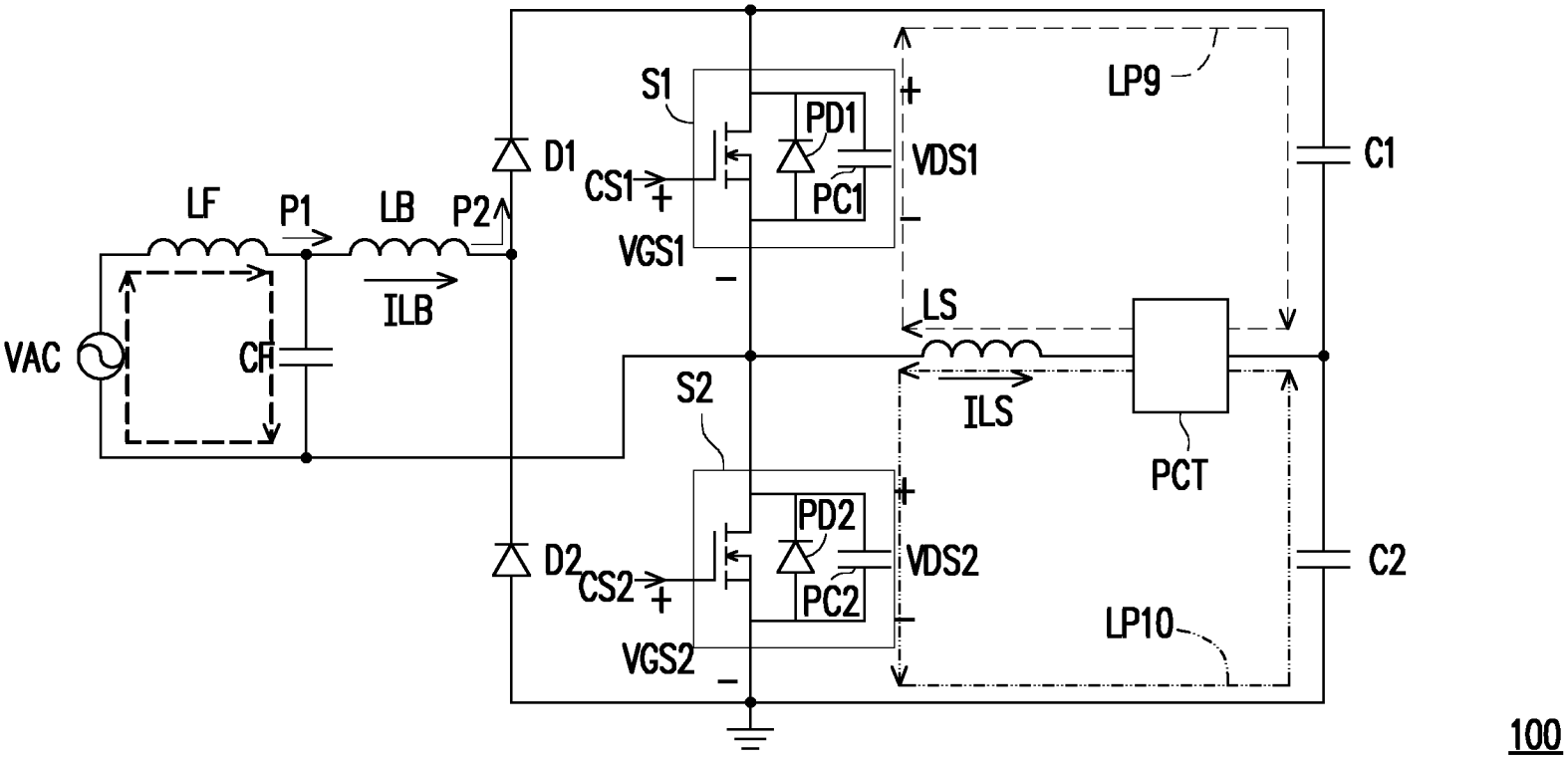

As shown in FIG. 2 and FIG. 3E, at the time point t4, the driving device 100 disconnects the second power switch S2 according to the second control signal CS2. The parasitic capacitor PC1 of the first power switch S1, the first capacitor C1, the transducer PCT, and the series inductor LS form an energy loop LP9. The electric energy stored in the series inductor LS and the parasitic capacitor PC1 of the first power switch S1 is provided to the first capacitor C1 and the transducer PCT via the energy loop LP9. The series inductor LS, the parasitic capacitor PC2 of the second power switch S2, the second capacitor C2, and the transducer PCT form an energy loop LP10. The electric energy stored in the second capacitor C2 and the series inductor LS is provided to the parasitic capacitor PC2 of the second power switch S2 and the transducer PCT. When the electric energy stored in the parasitic capacitor PC1 of the first power switch S1 is released completely at a time point t5 (the voltage difference VDS1 drops to 0 V), the intrinsic diode PD1 of the first power switch S1 is conducted.

Figure 3F:
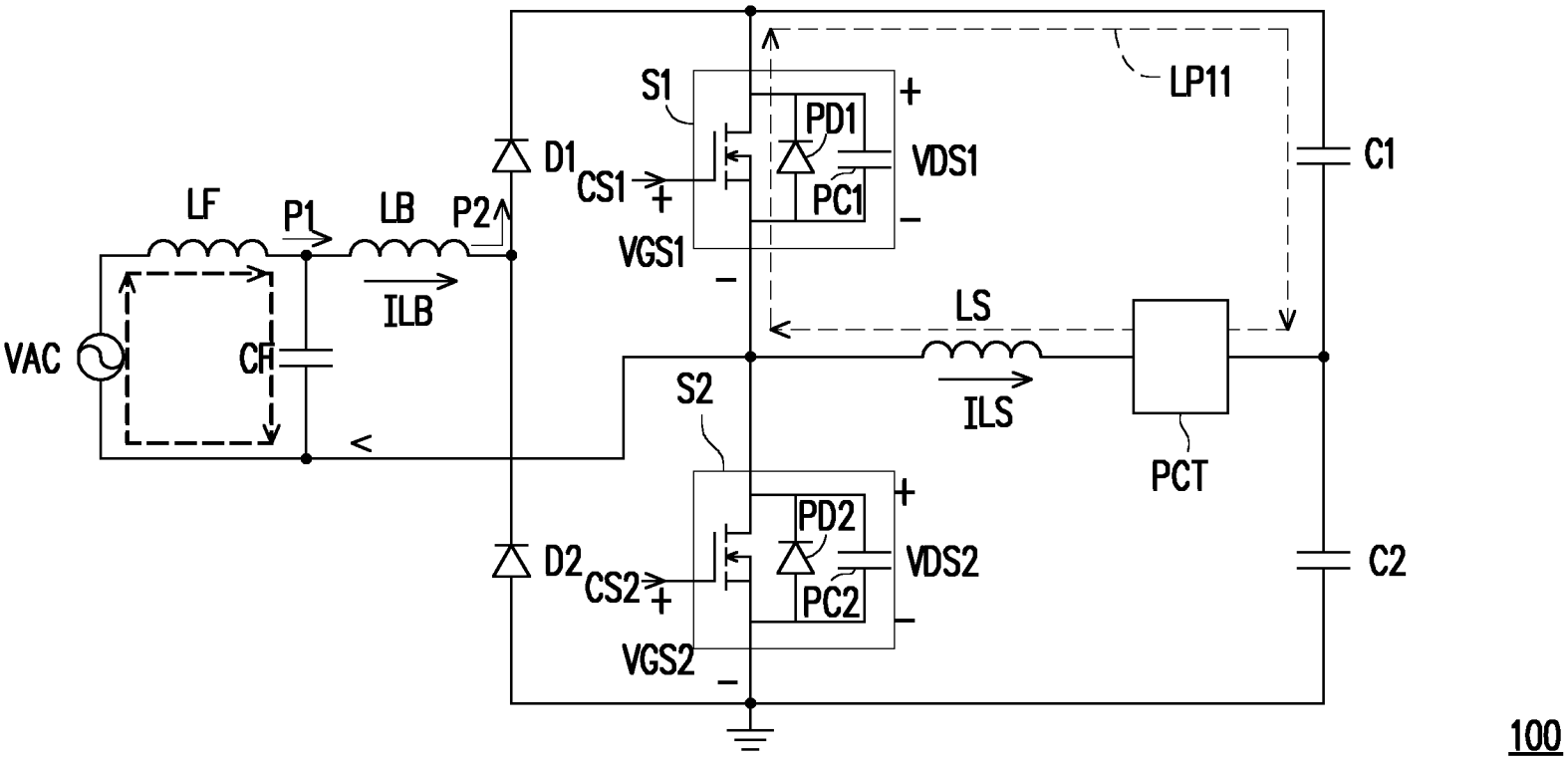

As shown in FIG. 2 and FIG. 3F, the intrinsic diode PD1 of the first power switch S1 is conducted. Therefore, the series inductor LS, the intrinsic diode PD1 of the first power switch S1, the first capacitor C1, and the transducer PCT form an energy loop LP11. The electric energy stored in the series inductor LS is provided to the first capacitor C1 and the transducer PCT via the energy loop LP11. When the first power switch S1 is conducted according to the first control signal at a time point t6, to switch from the second mode MD2 to the first mode MD1, and the boost inductor LB returns to a conducted state in the first mode MD1. Next, return to the implementation content shown in FIG. 2 and FIG. 3A.

Incidentally, the time point t6 may be advanced or delayed to adjust a conducted time of the boost inductor LB, thereby correcting power factors. That is, the time point t6 may be equal to the time point t5 or later than the time point t5. Therefore, based on the adjustment of the time points t3 and t6, at least one of a work cycle of the first power switch S1 and a work cycle of the second power switch S2 is less than 50%. Therefore, as can be seen, the driving device 100 makes the boost inductor LB be operated in equivalence in a discontinuous conduction mode, so that the driving device 100 can have effects of correcting power factors and reducing a switching loss of a drive circuit in a high-frequency operation.

Based on the above, the driving device of the invention is operated in equivalence in the discontinuous conduction mode by using the boost inductor, so that the driving device has the effect of correcting power factors. In addition, ZVS occurs when the driving device switches from the first mode to the second mode, thereby reducing the switching loss.

Although the invention is described with reference to the above embodiments, the embodiments are not intended to limit the invention. A person of ordinary skill in the art may make variations and modifications without departing from the spirit and scope of the invention. Therefore, the protection scope of the invention should be subject to the appended claims.

What is claimed is:

1. A driving device, adapted to drive a transducer, comprising:

a boost inductor, configured to receive a first power via a first terminal of the boost inductor in a first mode and provide a second power via a second terminal of the boost inductor;

a rectifying circuit, coupled to the second terminal of the boost inductor and configured to limit a transmission path of the second power; and a resonance circuit, coupled to the transducer and the rectifying circuit, and configured to store a stored electric energy from the second power in the first mode, so that the boost inductor does not provide the second power in a second mode and drives the transducer by the stored electric energy in the first mode and the second mode, wherein the first mode and the second mode are alternately operated, wherein the resonance circuit comprises:

a first capacitor, wherein a first terminal of the first capacitor is coupled to a first terminal of the rectifying circuit, and a second terminal of the first capacitor is coupled to one of power electrodes of the transducer; and a second capacitor, wherein a first terminal of the second capacitor is coupled to the second terminal of the first capacitor, and a second terminal of the second capacitor is coupled to a second terminal of the rectifying circuit.

2. The driving device according to claim 1, wherein the resonance circuit further comprises:

a first power switch, wherein a first terminal of the first power switch is coupled to the second terminal of the boost inductor via the rectifying circuit and a control terminal of the first power switch is configured to receive a first control signal from a control signal generator;

a second power switch, wherein a first terminal of the second power switch is coupled to a second terminal of the first power switch, a second terminal of the second power switch is coupled to a reference low potential, and a control terminal of the second power switch is configured to receive a second control signal from the control signal generator;

a series inductor, wherein a first terminal of the series inductor is coupled to the second terminal of the first power switch, and a second terminal of the series inductor is coupled to the other one of power electrodes of the transducer.

3. The driving device according to claim 2, wherein at least one of a work cycle of the first power switch and a work cycle of the second power switch is less than 50%.

4. The driving device according to claim 2, further comprising:

a filter, configured to receive an external power and filter out noise of the external power to provide the first power.

5. The driving device according to claim 4, wherein the filter comprises:

a filter inductor, wherein a first terminal of the filter inductor is used as one of power pins connected to the external power and a second terminal of the filter inductor is coupled to the first terminal of the boost inductor, wherein the second terminal of the filter inductor is used as an output terminal of the filter; and a filter capacitor, wherein a first terminal of the filter capacitor is coupled to the first terminal of the boost inductor and the second terminal of the filter inductor, a second terminal of the filter capacitor is used as the other one of the power pins connected to the external power, and the second terminal of the filter capacitor is further coupled to the second terminal of the first power switch.

6. The driving device according to claim 2, wherein the rectifying circuit comprises:

a first diode, wherein a cathode of the first diode is coupled to the first terminal of the first power switch and an anode of the first diode is coupled to the second terminal of the boost inductor; and a second diode, wherein a cathode of the second diode is coupled to the anode of the first diode and an anode of the second diode is coupled to the reference low potential.

7. The driving device according to claim 2, wherein when a current value generated by the first power flowing through the boost inductor rises to a maximum current value, the resonance circuit disconnects the first power switch according to the first control signal.

8. The driving device according to claim 7, wherein in response to that the current value generated by the first power flowing through the boost inductor drops to 0 A under the first mode, the driving device conducts the second power switch according to the second control signal and switches from the first mode to the second mode.

9. The driving device according to claim 7, wherein in response to that an electric energy stored by a parasitic capacitor of the first power switch is completely released under the second mode, the driving device conducts the first power switch according to the first control signal and switches from the second mode to the first mode.

10. The driving device according to claim 2, wherein a current direction of the stored electric energy flowing through the transducer and the series inductor in the first mode is opposite to a current direction of the stored electric energy flowing through the transducer and the series inductor in the second mode.

* * * * *